US012221777B1

(12) United States Patent
Yan

(10) Patent No.: US 12,221,777 B1
(45) Date of Patent: Feb. 11, 2025

(54) COMBINED SHOWER HEAD

(71) Applicant: XIAMEN GALENPOO KITCHEN & BATHROOM TECHNOLOGY CO., LTD, Xiamen (CN)

(72) Inventor: Xiaoling Yan, Xiamen (CN)

(73) Assignee: XIAMEN GALENPOO KITHCEN & BATHROOM TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 18/893,912

(22) Filed: Sep. 23, 2024

(30) Foreign Application Priority Data

Aug. 21, 2024 (CN) ..... 202422027877.1

(51) Int. Cl.
*E03C 1/04* (2006.01)
*E03C 1/02* (2006.01)

(52) U.S. Cl.
CPC ..... *E03C 1/0408* (2013.01); *E03C 2001/026* (2013.01)

(58) Field of Classification Search
CPC ... E03D 1/0408; E03C 2001/026; B05B 1/16; B05B 1/18
See application file for complete search history.

(56) References Cited

U.S. PATENT DOCUMENTS

| | | | | |
|---|---|---|---|---|
| 4,975,993 | A * | 12/1990 | Black | B05B 15/652 4/615 |
| 6,442,775 | B1 * | 9/2002 | Gransow | E03C 1/0408 4/615 |
| 10,159,993 | B1 * | 12/2018 | Lin | E03C 1/06 |
| 10,919,056 | B2 * | 2/2021 | Luo | B05B 1/1636 |
| 11,179,735 | B2 * | 11/2021 | Wu | B05B 1/207 |
| 11,426,741 | B2 * | 8/2022 | Wu | B05B 1/1645 |
| 11,525,249 | B1 * | 12/2022 | Yan | B05B 1/1672 |
| 2017/0173603 | A1 * | 6/2017 | Lin | B05B 1/1636 |

* cited by examiner

*Primary Examiner* — Christine J Skubinna

(57) ABSTRACT

This patent discloses a combined shower head, including a top spray, a handheld spray, and a water outlet switching apparatus. The switching apparatus has a first and second water outlet channels, and a switching valve core controlling the channels to discharge water. The handheld spray is detachably connected to the switching apparatus. A water inlet end communicates with the second water outlet channel via a flexible pipe. The top spray is connected to the switching apparatus via two water-flowing swing rods, and two ends of the swing rods are rotatably connected to the top spray and the switching apparatus, respectively. A water flowing channel that enables communication between an inner cavity of the top spray and the first water outlet channel is formed therein. A sealing ring and a damping piece are respectively clamped at junctions between the swing rod and the switching apparatus, as well as the top spray.

10 Claims, 9 Drawing Sheets

COMBINED SHOWER HEAD

BACKGROUND

1. Technical Field

The present invention relates to the field of bathroom fixtures, specifically to a combined shower head.

2. Background Information

In the existing combined shower heads, the handheld shower head is typically and detachably mounted onto the top spray shower head, thus eliminating the holder fixing the handheld shower head and achieving product simplification and integration. However, the existing combined shower heads have a problem: the water outlet angle of the top spray shower head cannot be adjusted flexibly, resulting in limitation during use.

In view of the above problem, it is necessary to develop a combined shower head that allows for flexible adjustment of the water outlet angle of the top spray shower head.

BRIEF SUMMARY

An objective of the present invention is to provide a combined shower head that allows for flexible adjustment of the water outlet angle of the top spray shower head.

To achieve the above objective, the present invention provides the following solution:

A combined shower head is provided, including a top spray shower head, a handheld shower head, and a water outlet switching apparatus. The water outlet switching apparatus has a first water outlet channel, a second water outlet channel, and a switching valve core that controls whether the first water outlet channel and the second water outlet channel discharge water. The handheld shower head is detachably connected to the water outlet switching apparatus, and a water inlet end of the handheld shower head communicates with the second water outlet channel via a flexible pipe. The top spray shower head is connected to the water outlet switching apparatus via two water-flowing swing rods, first ends of the water-flowing swing rods are rotatably connected to two sides of the water outlet switching apparatus, respectively, and second ends of the two water-flowing swing rods are rotatably connected to the top spray shower head. A water flowing channel that enables communication between an inner cavity of the top spray shower head and the first water outlet channel is formed in the water-flowing swing rod. A first sealing ring and a wear-resistant damping piece are clamped at a rotation junction between the water-flowing swing rod and the water outlet switching apparatus, and a second sealing ring is clamped at a rotation junction between the water-flowing swing rod and the top spray shower head.

The first end of the water-flowing swing rod forms a hollow first connecting joint. A side wall of the first connecting joint is provided with two such first sealing rings, and the side wall of the first connecting joint is provided with a water flowing inlet located between the two first sealing rings. The water flowing inlet of the first connecting joint communicates with the water flowing channel of the water-flowing swing rod. The water outlet switching apparatus is provided with a hinge channel that rotatably accommodates the first connecting joint of the water-flowing swing rod. A side wall of the hinge channel is provided with a water outlet opening in communication with the first water outlet channel. The two first sealing rings fitting with the first connecting joint sealingly fit with an inner wall of the hinge channel, and the water flowing inlet of the first connecting joint communicates with the first water outlet channel via the water outlet opening. The wear-resistant damping piece that abuts against a side surface of the first connecting joint is fixedly provided in the water outlet switching apparatus.

The wear-resistant damping piece abuts against side surfaces of the first connecting joints of the two water-flowing swing rods.

The second end of the water-flowing swing rod forms a hollow second connecting joint, a side wall of the second connecting joint is provided with two such second sealing rings, the side wall of the second connecting joint is provided with a water flowing outlet located between the two second sealing rings, and the water flowing outlet of the second connecting joint communicates with the water flowing channel of the water-flowing swing rod. The top spray shower head is provided with a hinge passage that rotatably accommodates the second connecting joint of the water-flowing swing rod, and a side wall of the hinge passage is provided with a water inlet opening in communication with the inner cavity of the top spray shower head. The two second sealing rings fitting with the second connecting joint sealingly fit with an inner wall of the hinge passage, the water flowing outlet of the second connecting joint communicates with the inner cavity of the top spray shower head via the water inlet opening, a hinge rod that is sleeved with the second connecting joint is disposed in the hinge passage, and the hinge rod is provided with a screw to be in limited engagement with the second connecting joint.

The water outlet switching apparatus includes a switching body and the switching valve core. The switching body is provided with a water inlet port, a switching channel, and the first water outlet channel. An inner wall of the switching channel is provided with a water inlet hole and a water outlet hole that are opposite, and the water inlet hole and the water outlet hole respectively communicate with the water inlet port and the first water outlet channel. The second water outlet channel is formed in the switching valve core, an outer wall of the switching valve core forms a water flowing groove and a water flowing through-hole in communication with the second water outlet channel, and the switching valve core is rotatably inserted into the switching channel and provided with a sealing ring that sealingly fits the inner wall of the switching channel. The water flowing groove of the switching valve core movably communicates with the water inlet hole and the water outlet hole, and the water flowing through-hole of the switching valve core movably communicates with the water inlet hole.

The outer wall of the switching valve core is provided with a water-flowing sealing ring that surrounds the water flowing through-hole, and the water-flowing sealing ring sealingly fits with the inner wall of the switching channel.

The switching valve core is provided with a positioning pin, and a positioning groove allowing for movable insertion of the positioning pin is provided in the switching channel.

The water outlet switching apparatus is magnetically connected to the handheld shower head.

The handheld shower head is provided with a plug connector, the plug connector is provided with a movable magnet, the switching body is provided with a plug slot in inserted fitting with the plug connector, and a fixed magnet that is magnetically attracted to the movable magnet is provided in the plug slot.

The top spray shower head has a fitting notch for movable docking with the handheld shower head.

With the use of the above solution, in the present invention, the top spray shower head is connected to the water outlet switching apparatus via the two water-flowing swing rods. The first ends of the two water-flowing swing rods are rotatably connected to the two sides of the water outlet switching apparatus, respectively, and the second ends of the two water-flowing swing rods are rotatably connected to the top spray shower head. This arrangement allows the top spray shower head to rotate around the water-flowing swing rods and the water-flowing swing rods to rotate around the water outlet switching apparatus. Therefore, in the present invention, the top spray shower head and the water-flowing swing rods are rotated to adjust the water outlet angle of the top spray shower head flexibly and stably with a wide range. The inner cavity of the top spray shower head communicates with the first water outlet channel of the water outlet switching apparatus through the water flowing channel of the water-flowing swing rod. This enhances the integration of the combined shower head of the present invention. Additionally, the first sealing ring and the wear-resistant damping piece are clamped at the rotation junction between the water-flowing swing rod and the water outlet switching apparatus, and the second sealing ring is clamped at the rotation junction between the water-flowing swing rod and the top spray shower head. The first sealing ring and the second sealing ring can provide a waterproofing function, and the wear-resistant damping piece stably provides rotational damping, ensuring that the top spray shower head can be positioned at the desired water outlet angle.

Figure 1:
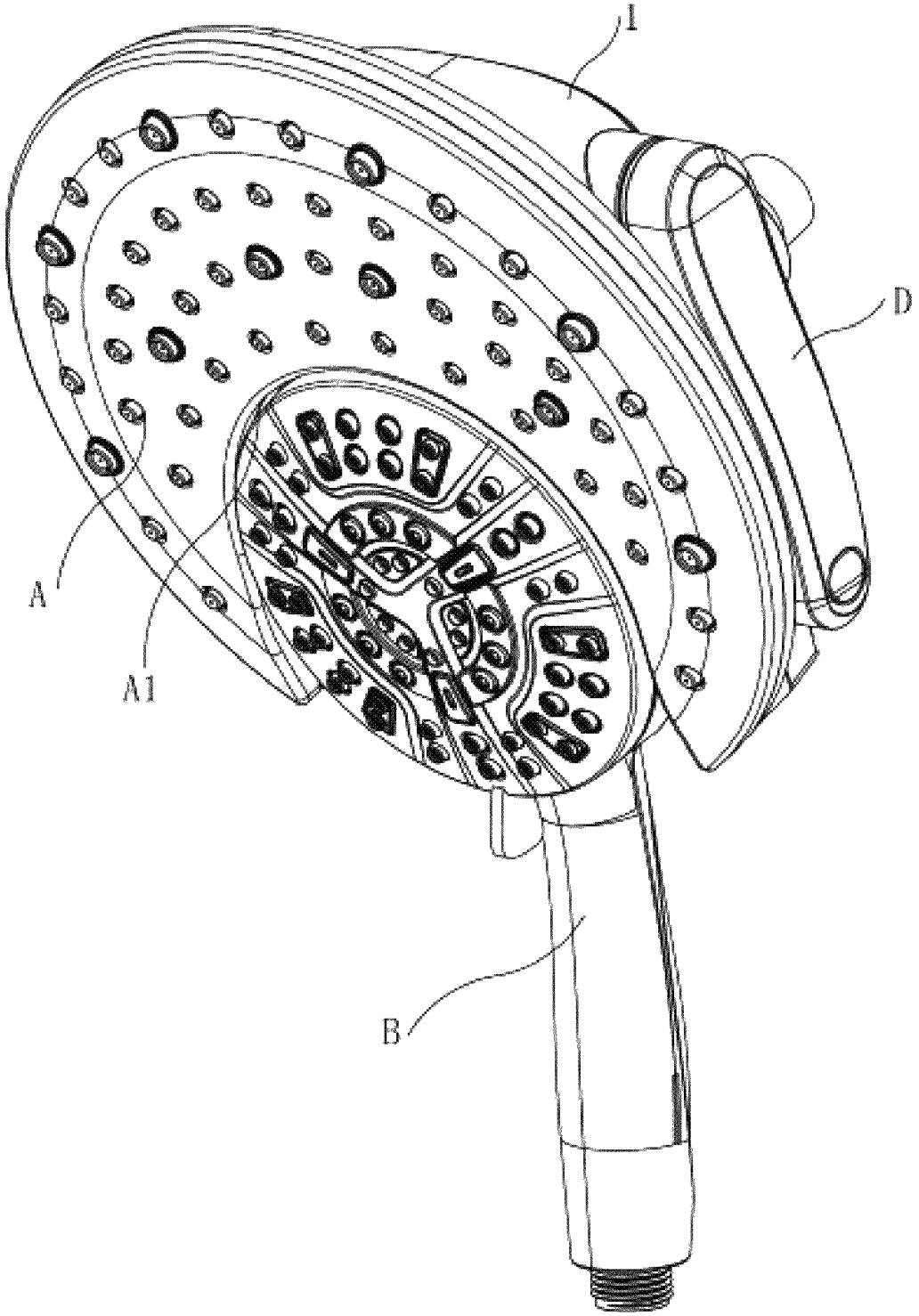
FIG. 1 is a schematic structural diagram according to the present invention.

DESCRIPTION OF NUMERAL REFERENCES top spray shower head A, hinge passage A1, water inlet opening A11, hinge rod A12, fitting notch A2, screw A3, handheld shower head B, plug connector B1, movable magnet B11, water outlet switching apparatus C, switching body 1, body housing 101, fixing holder 102, limiting base 103, body face cover 104, first water outlet channel 11, water inlet port 12, switching channel 13, water inlet hole 131, water outlet hole 132, positioning groove 133, plug slot 14, fixed magnet 141, hinge channel 15, water outlet opening 151, switching valve core 2, second water outlet channel 21, water flowing groove 22, water flowing through-hole 23, switching handle 24, sealing ring 3, water-flowing sealing ring 4, positioning pin 5, universal joint 6, wear-resistant damping piece 7, water-flowing swing rod D, water flowing channel D1, first connecting joint D2, water flowing inlet D21, second connecting joint D3, water flowing outlet D31, first sealing ring E, and second sealing ring F.

DETAILED DESCRIPTION OF THE DRAWINGS AND THE PRESENTLY PREFERRED EMBODIMENTS

To further describe the technical solutions of the present invention, the present invention is described below in detail with reference to specific embodiments.

Figure 2:
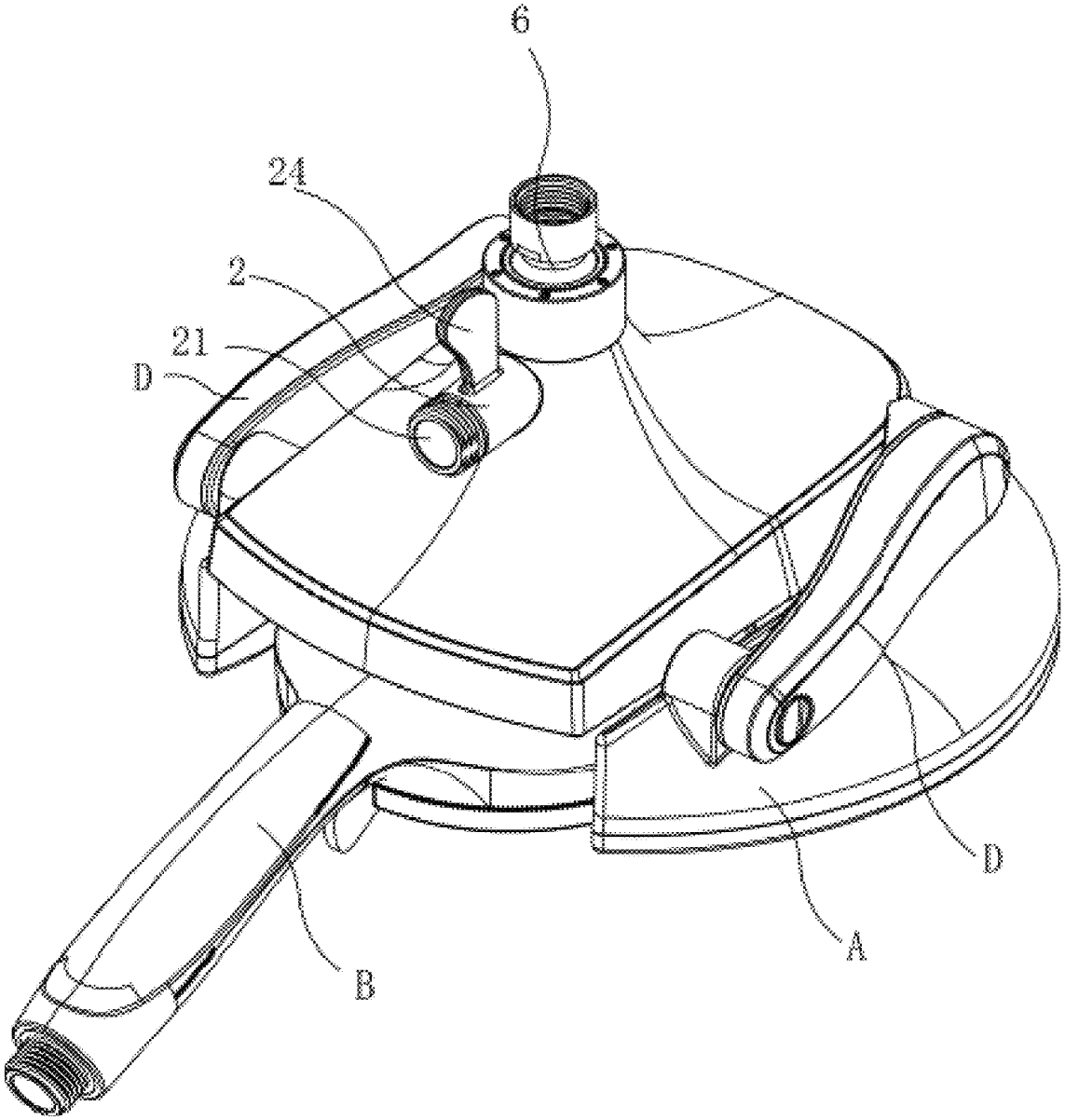
FIG. 2 is a schematic structural diagram according to the present invention.
Figure 3:
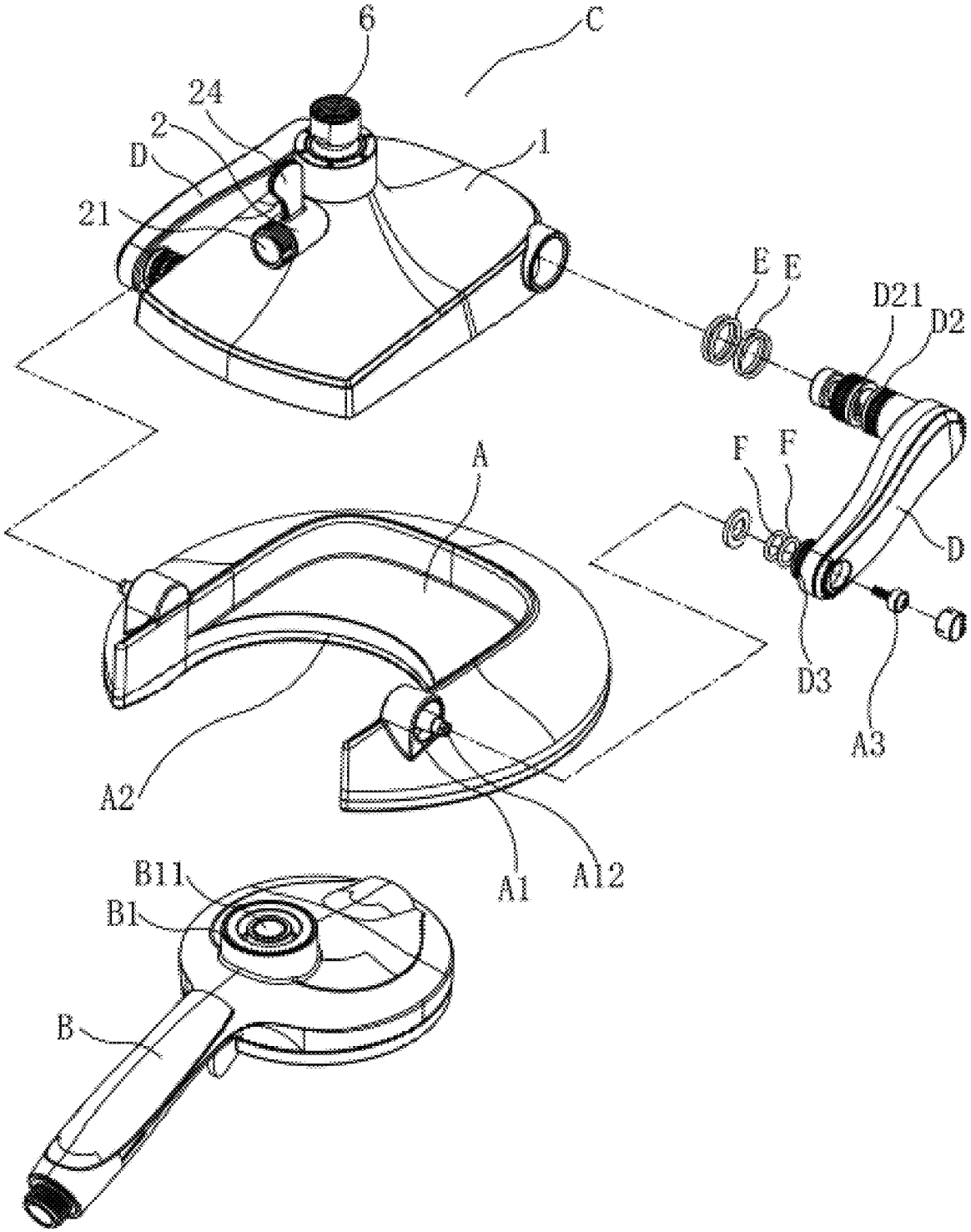
FIG. 3 is a structural exploded view according to the present invention.
Figure 4:
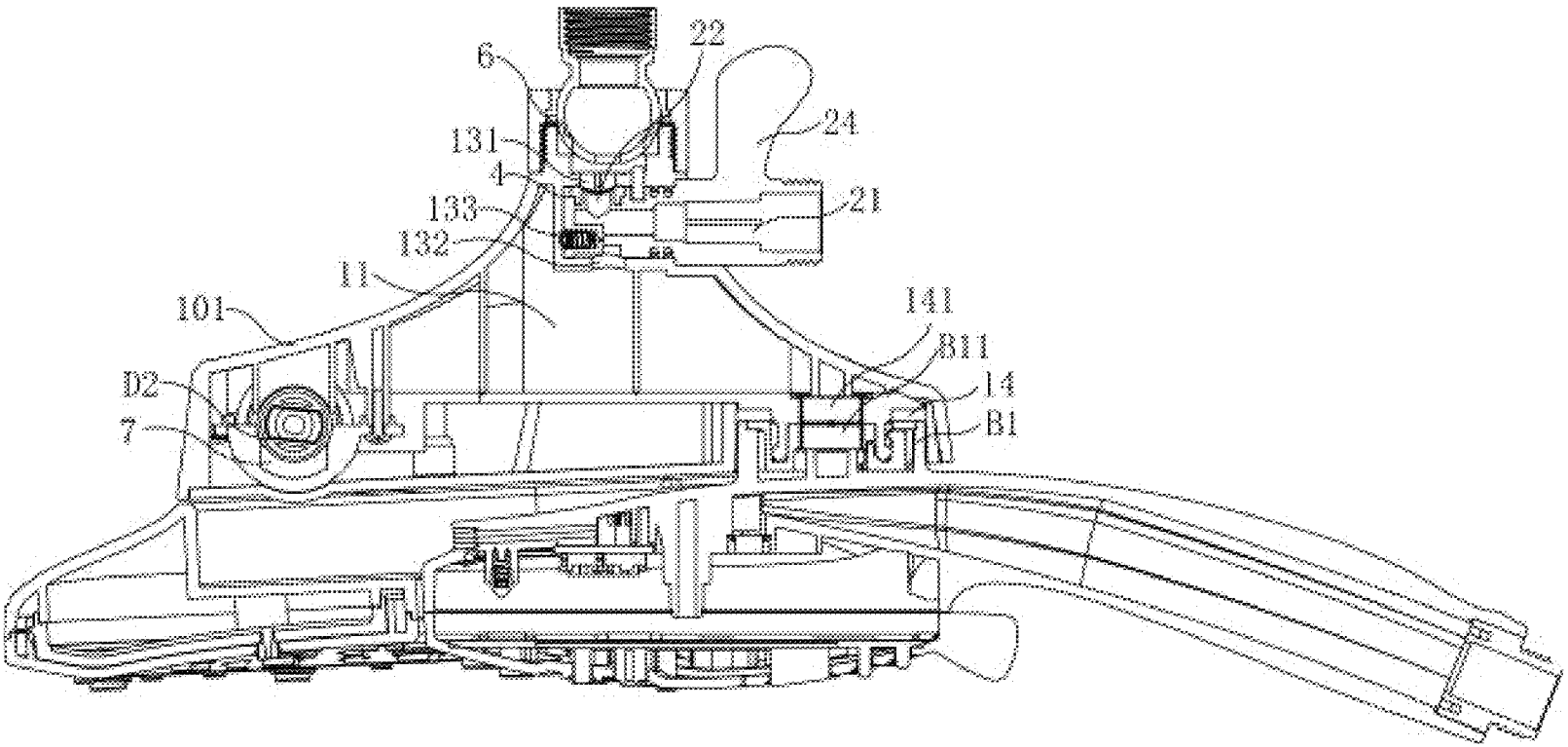
FIG. 4 is a first sectional view according to the present invention.
Figure 5:
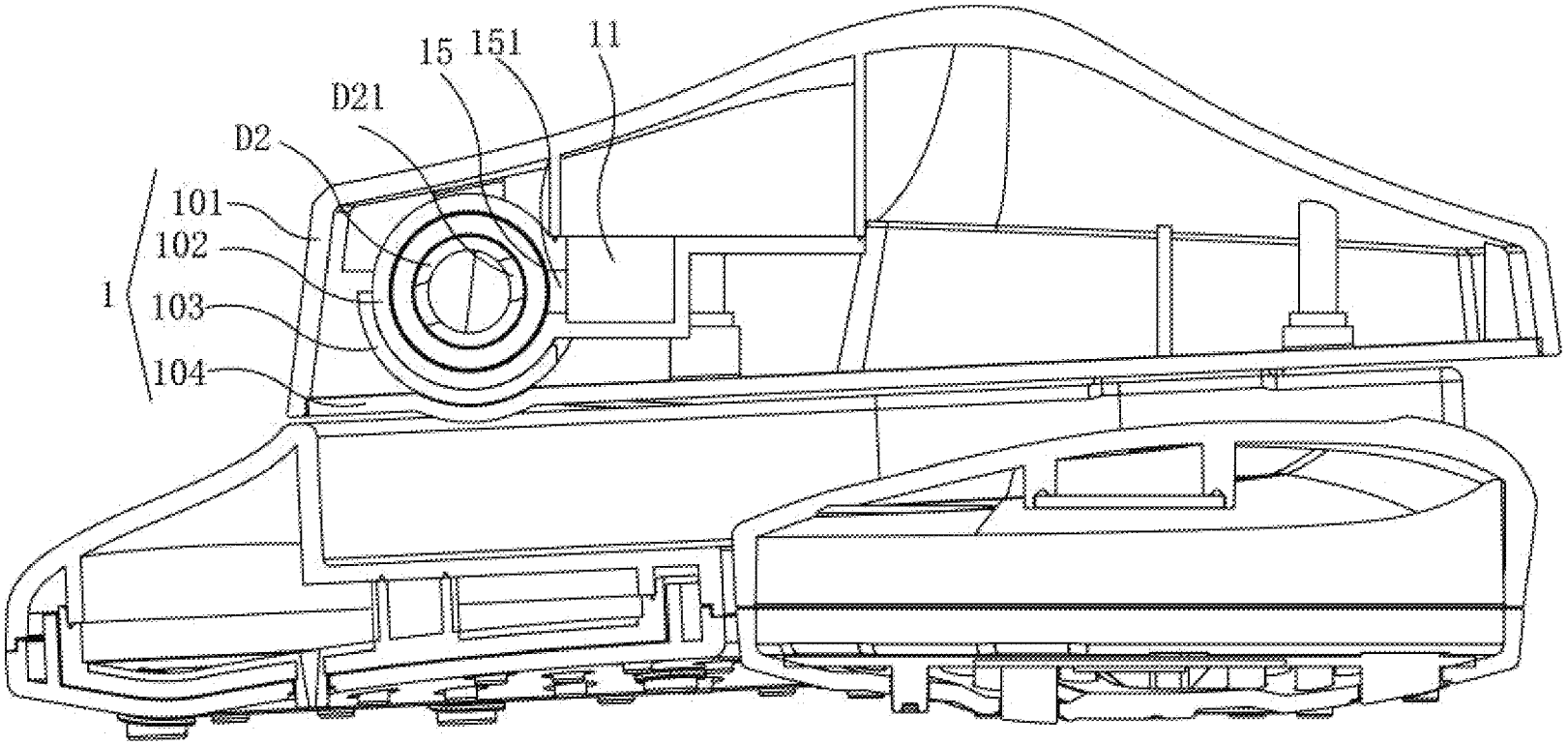
FIG. 5 is a second sectional view according to the present invention.
Figure 6:
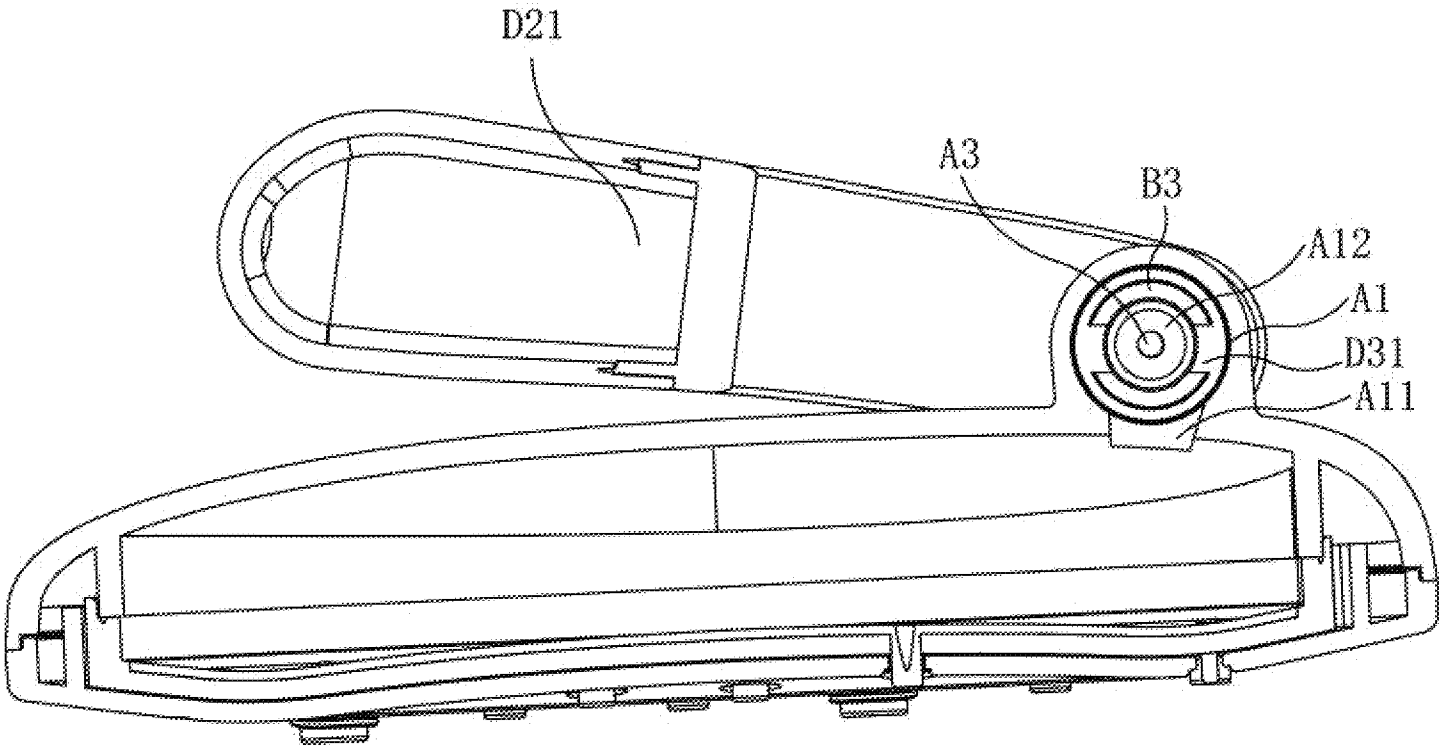
FIG. 6 is a third sectional view according to the present invention.
Figure 7:
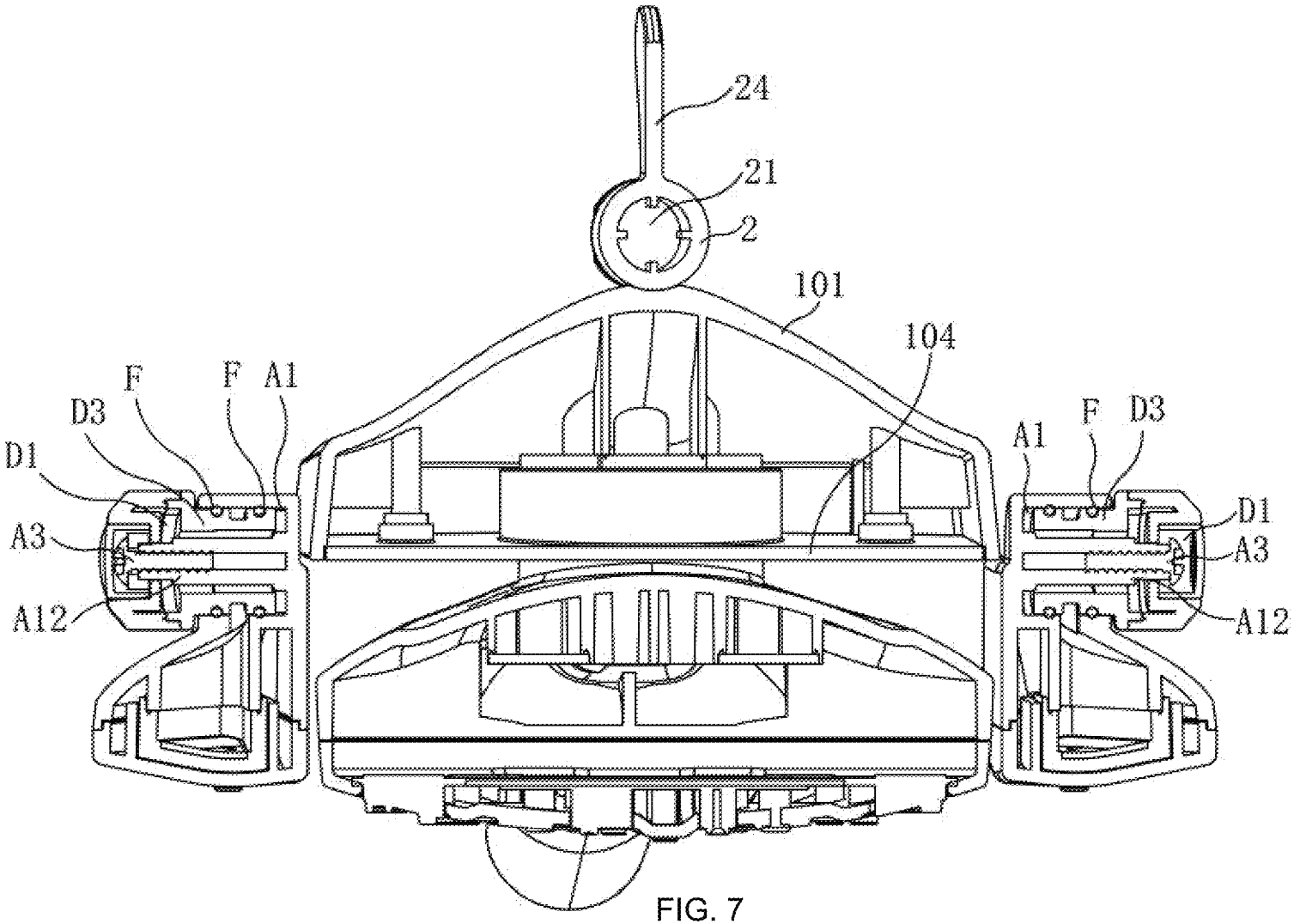
FIG. 7 is a fourth sectional view according to the present invention.
Figure 8:
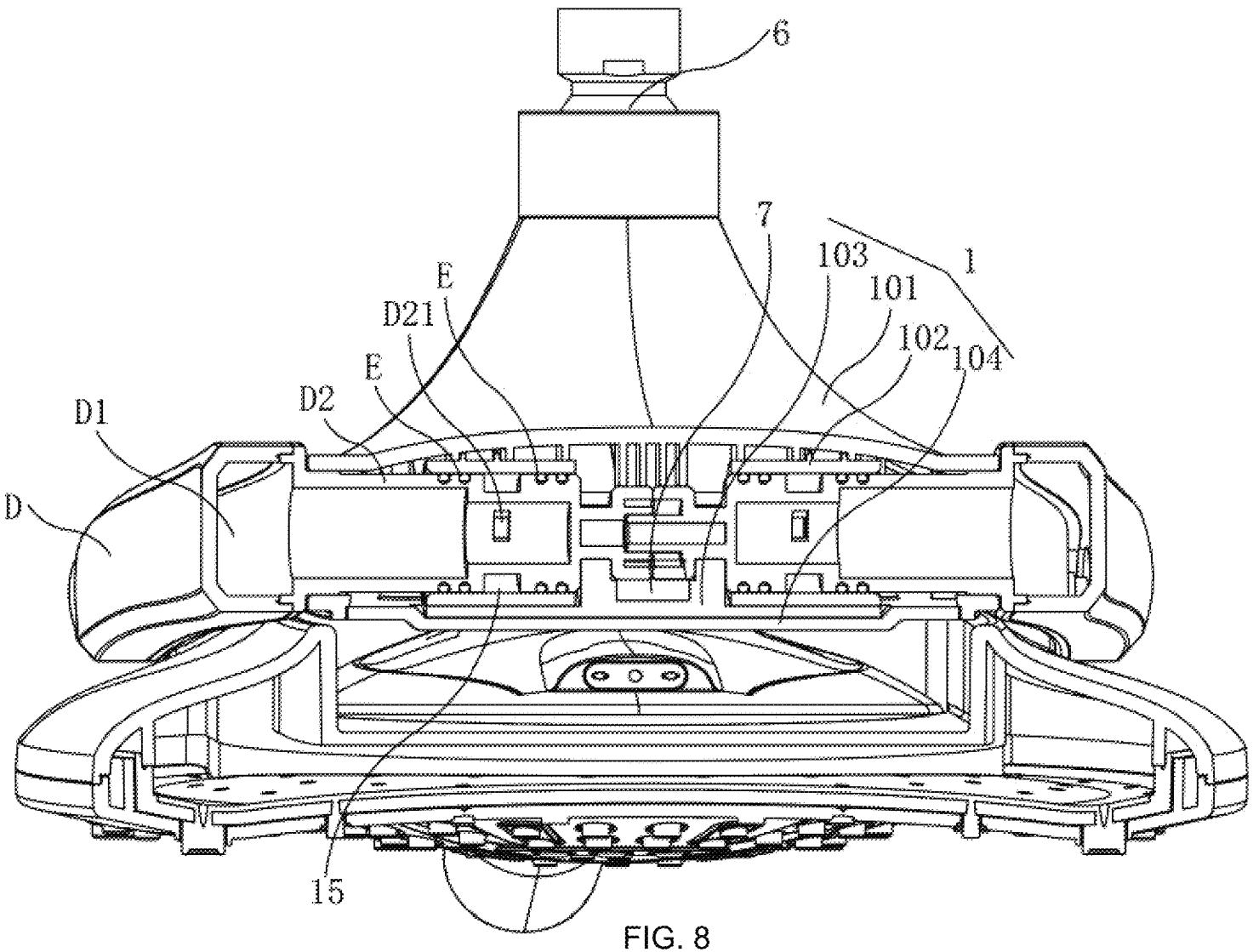
FIG. 8 is a fifth sectional view according to the present invention.
Figure 9:
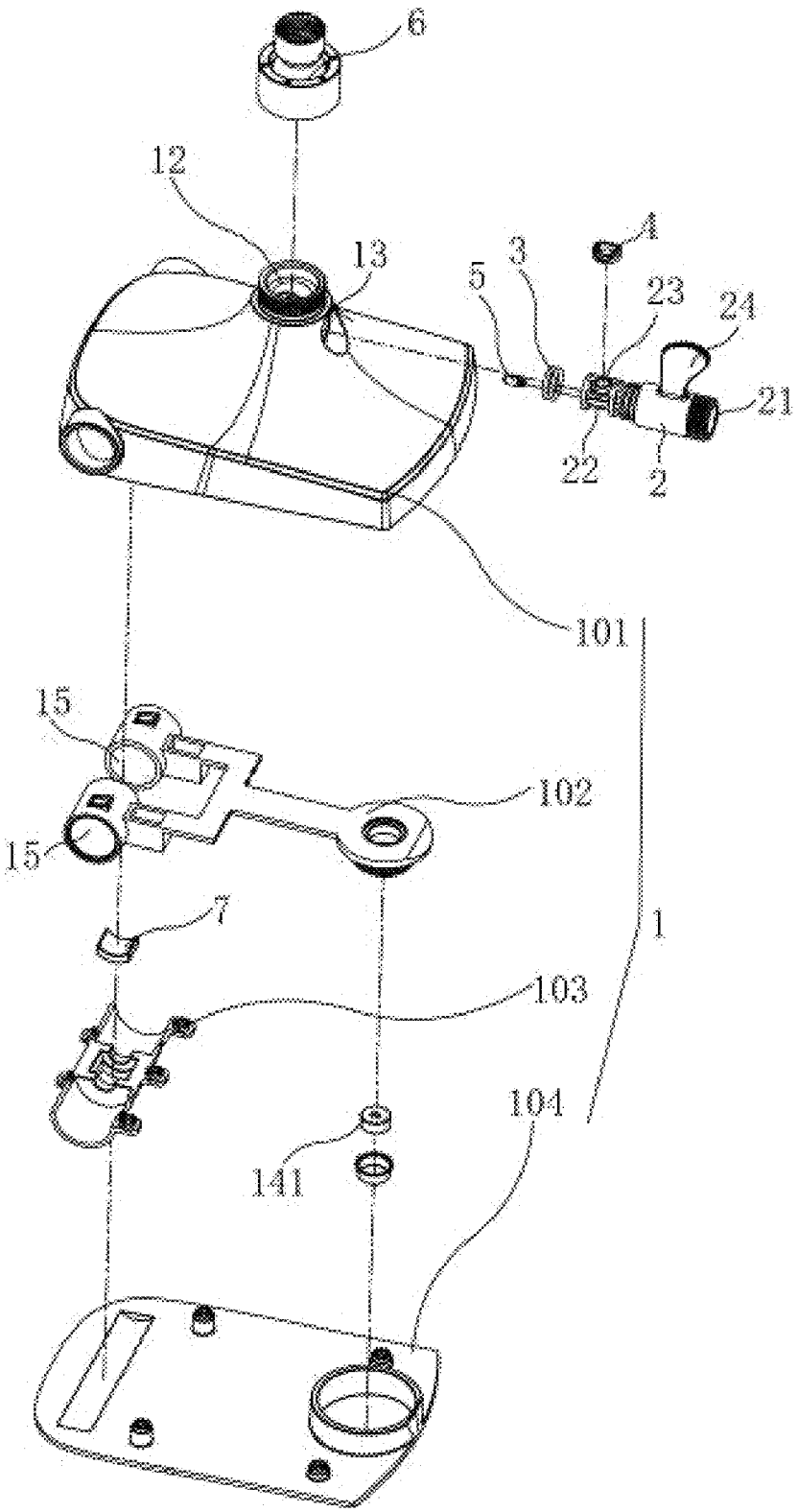
FIG. 9 is a structural exploded diagram of a water outlet switching apparatus according to the present invention.

As shown in FIGS. 1 to 9, the present invention discloses a combined shower head, including a top spray shower head A, a handheld shower head B, and a water outlet switching apparatus C. The water outlet switching apparatus C has a first water outlet channel 11, a second water outlet channel 21, and a switching valve core 2 that controls whether the first water outlet channel 11 and the second water outlet channel 21 discharge water. The handheld shower head B is detachably connected to the water outlet switching apparatus C, and a water inlet end of the handheld shower head B communicates with the second water outlet channel 21 via a flexible pipe (not shown in the figure). The top spray shower head A is connected to the water outlet switching apparatus C via two water-flowing swing rods D, first ends of the water-flowing swing rods D are rotatably connected to two sides of the water outlet switching apparatus C, respectively, and second ends of the two water-flowing swing rods D are rotatably connected to the top spray shower head A. A water flowing channel D1 that enables communication between an inner cavity of the top spray shower head A and the first water outlet channel 11 is formed in the water-flowing swing rod D. A first sealing ring E and a wear-resistant damping piece 7 are clamped at a rotation junction between the water-flowing swing rod D and the water outlet switching apparatus C, and a second sealing ring F is clamped at a rotation junction between the water-flowing swing rod D and the top spray shower head A.

In the present invention, the top spray shower head A is connected to the water outlet switching apparatus C via the two water-flowing swing rods D. The first ends of the two water-flowing swing rods D are rotatably connected to the two sides of the water outlet switching apparatus C, respectively, and the second ends of the two water-flowing swing rods D are rotatably connected to the top spray shower head A. This arrangement allows the top spray shower head A to rotate around the water-flowing swing rods D and the water-flowing swing rods D to rotate around the water outlet switching apparatus C. Therefore, in the present invention, the top spray shower head A and the water-flowing swing rods D are rotated to adjust the water outlet angle of the top spray shower head flexibly and stably with a wide range. The inner cavity of the top spray shower head A communicates with the first water outlet channel 11 of the water outlet switching apparatus C through the water flowing channel D1 of the water-flowing swing rod D. This enhances the integration of the combined shower head of the present invention. Additionally, the first sealing ring E is clamped at the rotation junction between the water-flowing swing rod D and the water outlet switching apparatus C, and the second sealing ring F and the wear-resistant damping piece 7 are clamped at the rotation junction between the water-flowing swing rod D and the top spray shower head A. The first sealing ring E and the second sealing ring F can provide a waterproofing function, and the wear-resistant damping piece 7 stably provides rotational damping, ensuring that the top spray shower head A can be positioned at the desired water outlet angle.

In the embodiments of the present invention, the water outlet switching apparatus C includes a switching body 1 and the switching valve core 2. The switching body 1 may be at least formed by connecting a body housing 101, a fixing holder 102, a limiting base 103, and a body face cover 104. The switching body 1 is provided with a water inlet port 12, a switching channel 13, and the first water outlet channel 11. The water inlet port 12 may be connected to a universal joint 6, so as to adjust the angle of the water outlet switching apparatus C. An inner wall of the switching channel 13 is provided with a water inlet hole 131 and a water outlet hole 132 that are opposite, and the water inlet hole 131 and the water outlet hole 132 respectively communicate with the water inlet port 12 and the first water outlet channel 11. The second water outlet channel 21 is formed in the switching valve core 2, an outer wall of the switching valve core 2 forms a water flowing groove 22 and a water flowing through-hole 23 in communication with the second water outlet channel 21, and the switching valve core 2 is rotatably inserted into the switching channel 13 and provided with a sealing ring 3 that sealingly fits the inner wall of the switching channel 13, preventing water leakage. The water flowing groove 22 of the switching valve core 2 movably communicates with the water inlet hole 131 and the water outlet hole 132, and the water flowing through-hole 23 of the switching valve core 2 movably communicates with the water inlet hole 131. When the switching valve core 2 is rotated so that only the water flowing through-hole 23 of the switching valve core 2 communicates with the water inlet hole 131, the water inlet port 12 communicates with the second water outlet channel 21 via the water flowing through-hole 23, and the second water outlet channel 21 discharges water, causing the handheld shower head B to discharge water. When the switching valve core 2 is rotated so that only the water flowing groove 22 communicates with the water inlet hole 131 and the water flowing groove 22 communicates with the water outlet hole 132, the water inlet port 12 communicates with the first water outlet channel 11 via the water flowing groove 22, and the first water outlet channel 11 discharges water, causing the top spray shower head A to discharge water. When the switching valve core 2 is rotated so that the water flowing through-hole 23 of the switching valve core 2 communicates with the water inlet hole 131 and the water flowing groove 22 communicates with both the water inlet hole 131 and the water outlet hole 132, the water inlet port 12 communicates with both the first water outlet channel 11 and the second water outlet channel 21, and the first water outlet channel 11 and the second water outlet channel 21 discharge water, causing both the top spray shower head A and the handheld shower head B to discharge water.

In the embodiments of the present invention, the outer wall of the switching valve core 2 is provided with a water-flowing sealing ring 4 that surrounds the water flowing through-hole 23, and the water-flowing sealing ring 4 sealingly fits with the inner wall of the switching channel 13. The water-flowing sealing ring 4 can ensure that the first water outlet channel 11 and the second water outlet channel 21 can discharge water independently. The switching valve core 2 may be provided with a positioning pin 5, and a positioning groove 133 allowing for movable insertion of the positioning pin 5 is provided in the switching channel 13. When the positioning pin 5 is embedded in the positioning groove 133, the water flowing through-hole 23 directly faces the water inlet hole 131.

In the embodiments of the present invention, the switching valve core 2 is connected to a switching handle 24 located on the outer wall of the switching channel 13. The switching handle 24 facilitates the rotation of the switching valve core 2.

In the embodiments of the present invention, the water outlet switching apparatus C and the handheld shower head B can be magnetically connected, such that the handheld shower head B is simple and convenient to assemble or disassemble relative to the water outlet switching apparatus C. Specifically, the handheld shower head B is provided with a plug connector B1, the plug connector B1 is provided with a movable magnet B11, the switching body 1 is provided with a plug slot 14 in inserted fitting with the plug connector B1, the plug slot 14 is disposed at the switching body 1, and a fixed magnet 141 that is magnetically attracted to the movable magnet B11 is provided in the plug slot 14.

In the embodiments of the present invention, the first end of the water-flowing swing rod D forms a hollow first connecting joint D2. A side wall of the first connecting joint D2 is provided with two such first sealing rings E, and the side wall of the first connecting joint D2 is provided with a water flowing inlet D21 located between the two first sealing rings E. The water flowing inlet D21 of the first connecting joint D2 communicates with the water flowing channel D1 of the water-flowing swing rod D. The water outlet switching apparatus C is provided with a hinge channel 15 that rotatably accommodates the first connecting joint D2 of the water-flowing swing rod D. The hinge channel 15 is provided with a switching body 1, and a side wall of the hinge channel 15 is provided with a water outlet opening 151 in communication with the first water outlet channel 11. The two first sealing rings E fitting with the first connecting joint D2 sealingly fit with an inner wall of the hinge channel 15, and the water flowing inlet D21 of the first connecting joint D2 communicates with the first water outlet channel 11 via the water outlet opening 151. This arrangement allows the water-flowing swing rod D to rotate relative to the water outlet switching apparatus C with rotational damping, and the water flowing channel D1 of the water-flowing swing rod D always communicates with the first water outlet channel 11 without water leakage. The water outlet switching apparatus C is fixedly provided with a wear-resistant damping piece 6 that abuts against the side surfaces of the first connecting joints D2 of the two water-flowing swing rods D. The wear-resistant damping piece 6 can be embedded in a groove within the water outlet switching apparatus C to prevent displacement. The wear-resistant damping piece 6 simultaneously abuts against the side surfaces of the first connecting joints D2 of the two water-flowing swing rods D, which helps to enhance the rotational damping between the water-flowing swing rods D and the water outlet switching apparatus C, thereby improving the stability of the water-flowing swing rods D.

In the embodiments of the present invention, the second end of the water-flowing swing rod D forms a hollow second connecting joint D3, a side wall of the second connecting joint D3 is provided with two such second sealing rings F, the side wall of the second connecting joint D3 is provided with a water flowing outlet D31 located between the two second sealing rings F, and the water flowing outlet D31 of the second connecting joint D3 communicates with the water flowing channel D1 of the water-flowing swing rod D. The top spray shower head A is provided with a hinge passage A1 that rotatably accommodates the second connecting joint D3 of the water-flowing swing rod D, and a side wall of the hinge passage A1 is provided with a water inlet opening A11 in communication with the inner cavity of the top spray shower head A. The two second sealing rings F fitting with the second connecting joint D3 sealingly fit with an inner wall of the hinge passage A1, and the water flowing outlet D31 of the second connecting joint D3 communicates with the inner cavity of the top spray shower head A via the water inlet opening A11. This arrangement allows the top spray shower head A to rotate relative to the water-flowing swing rod D with rotational damping, and the water flowing channel D1 of the water-flowing swing rod D always communicates with the inner cavity of the top spray shower head A without water leakage. Further, a hinge rod A12 that is sleeved with the second connecting joint D3 is disposed in the hinge passage A1, and the hinge rod A12 is provided with a screw A3 to be in limited engagement with the second connecting joint D3, thus effectively preventing detachment of the second connecting joint D3.

In the embodiments of the present invention, the top spray shower head A has a fitting notch A2 for movable docking with the handheld shower head B. In this way, the top spray shower head A can be moved to dock with the handheld shower head B, which is combined with the water outlet switching apparatus C (see FIG. 1), and both the top spray shower head A and the handheld shower head B can be controlled simultaneously to discharge water, increasing the shower area.

The above embodiments and figures do not limit the product form and style of the present invention. Any appropriate changes or modifications made by persons of ordinary skill in the art based on the present invention should fall into the patent scope of the present invention.

The invention claimed is:

1. A combined shower head, comprising a top spray shower head, a handheld shower head, and a water outlet switching apparatus; wherein the water outlet switching apparatus has a first water outlet channel, a second water outlet channel, and a switching valve core that controls whether the first water outlet channel and the second water outlet channel discharge water;

the handheld shower head is detachably connected to the water outlet switching apparatus, and a water inlet end of the handheld shower head communicates with the second water outlet channel via a flexible pipe; and the top spray shower head is connected to the water outlet switching apparatus via two water-flowing swing rods, first ends of the water-flowing swing rods are rotatably connected to two sides of the water outlet switching apparatus, respectively, second ends of the two water-flowing swing rods are rotatably connected to the top spray shower head, a water flowing channel that enables communication between an inner cavity of the top spray shower head and the first water outlet channel is formed in the water-flowing swing rod, a first sealing ring and a wear-resistant damping piece are clamped at a rotation junction between the water-flowing swing rod and the water outlet switching apparatus, and a second sealing ring is clamped at a rotation junction between the water-flowing swing rod and the top spray shower head.

2. The combined shower head according to claim 1, wherein the first end of the water-flowing swing rod forms a hollow first connecting joint, a side wall of the first connecting joint is provided with two such first sealing rings, the side wall of the first connecting joint is provided with a water flowing inlet located between the two first sealing rings, and the water flowing inlet of the first connecting joint communicates with the water flowing channel of the water-flowing swing rod; and the water outlet switching apparatus is provided with a hinge channel that rotatably accommodates the first connecting joint of the water-flowing swing rod, a side wall of the hinge channel is provided with a water outlet opening in communication with the first water outlet channel, the two first sealing rings fitting with the first connecting joint sealingly fit with an inner wall of the hinge channel, the water flowing inlet of the first connecting joint communicates with the first water outlet channel via the water outlet opening, and the wear-resistant damping piece that abuts against a side surface of the first connecting joint is fixedly provided in the water outlet switching apparatus.

3. The combined shower head according to claim 2, wherein the wear-resistant damping piece abuts against side surfaces of the first connecting joints of the two water-flowing swing rods.

4. The combined shower head according to claim 1, wherein the second end of the water-flowing swing rod forms a hollow second connecting joint, a side wall of the second connecting joint is provided with two such second sealing rings, the side wall of the second connecting joint is provided with a water flowing outlet located between the two second sealing rings, and the water flowing outlet of the second connecting joint communicates with the water flowing channel of the water-flowing swing rod; and the top spray shower head is provided with a hinge passage that rotatably accommodates the second connecting joint of the water-flowing swing rod, a side wall of the hinge passage is provided with a water inlet opening in communication with the inner cavity of the top spray shower head, the two second sealing rings fitting with the second connecting joint sealingly fit with an inner wall of the hinge passage, the water flowing outlet of the second connecting joint communicates with the inner cavity of the top spray shower head via the water inlet opening, a hinge rod that is sleeved with the second connecting joint is disposed in the hinge passage, and the hinge rod is provided with a screw to be in limited engagement with the second connecting joint.

5. The combined shower head according to claim 1, wherein the water outlet switching apparatus comprises a switching body and the switching valve core;

the switching body is provided with a water inlet port, a switching channel, and the first water outlet channel, an inner wall of the switching channel is provided with a water inlet hole and a water outlet hole that are opposite, and the water inlet hole and the water outlet hole respectively communicate with the water inlet port and the first water outlet channel, and the second water outlet channel is formed in the switching valve core, an outer wall of the switching valve core forms a water flowing groove and a water flowing through-hole in communication with the second water outlet channel, the switching valve core is rotatably inserted into the switching channel and provided with a sealing ring that sealingly fits the inner wall of the switching channel, the water flowing groove of the switching valve core movably communicates with the water inlet hole and the water outlet hole, and the water flowing through-hole of the switching valve core movably communicates with the water inlet hole.

6. The combined shower head according to claim 5, wherein the outer wall of the switching valve core is provided with a water-flowing sealing ring that surrounds the water flowing through-hole, and the water-flowing sealing ring sealingly fits with the inner wall of the switching channel.

7. The combined shower head according to claim 5, wherein the switching valve core is provided with a positioning pin, and a positioning groove allowing for movable insertion of the positioning pin is provided in the switching channel.

8. The combined shower head according to claim 1, wherein the water outlet switching apparatus is magnetically connected to the handheld shower head.

9. The combined shower head according to claim 8, wherein the handheld shower head is provided with a plug connector, the plug connector is provided with a movable magnet, the switching body is provided with a plug slot in inserted fitting with the plug connector, and a fixed magnet that is magnetically attracted to the movable magnet is provided in the plug slot.

10. The combined shower head according to claim 1, wherein the top spray shower head has a fitting notch for movable docking with the handheld shower head.

* * * * *